US006321673B2

(12) United States Patent
Lelan et al.

(10) Patent No.: US 6,321,673 B2
(45) **Date of Patent: *Nov. 27, 2001**

(54) AUTONOMOUS CONTAINER SHIP

(75) Inventors: Jean-Yves Lelan, Ploemeur; Olivier De Smirnoff, Port Louis; Daniel Person, Coueron; Christian Gilles Fournier, Issy-les-Moulineaux, all of (FR)

(73) Assignee: Etat Francais represente par le Delegue General pour l'Armament, Armees (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/214,104

(22) PCT Filed: Apr. 27, 1998

(86) PCT No.: PCT/FR98/00840

§ 371 Date: Feb. 3, 1999

§ 102(e) Date: Feb. 3, 1999

(87) PCT Pub. No.: WO98/49052

PCT Pub. Date: Nov. 5, 1998

(30) Foreign Application Priority Data

Apr. 29, 1997 (FR) ..... 97 05250

(51) Int. Cl.[7] ..... B63B 25/00
(52) U.S. Cl. ..... 114/72; 414/137.2
(58) Field of Search ..... 114/72, 73, 74 A, 114/74 R, 78, 125, 124; 414/137.2, 138.2, 138.7, 139.4, 139.6, 140.1, 140.4

(56) References Cited

U.S. PATENT DOCUMENTS

| | | | | |
|---|---|---|---|---|
| 3,397,664 | * | 8/1968 | Slager et al. | 114/124 |
| 3,587,505 | * | 6/1971 | Wells | 114/72 |
| 3,591,023 | | 7/1971 | Allen | 214/14 |
| 3,977,352 | * | 8/1976 | Pran et al. | 114/72 |
| 4,043,285 | | 8/1977 | Nordstrom | 114/72 |
| 4,371,350 | | 2/1983 | Kruppa et al. | 440/69 |
| 4,495,880 | * | 1/1985 | Maniscalco et al. | 114/123 |
| 5,038,696 | | 8/1991 | Athanasiou et al. | 114/56.1 |

FOREIGN PATENT DOCUMENTS

| | | |
|---|---|---|
| 811 668 A | 6/1974 | (BE) . |
| 811 669 A | 6/1974 | (BE) . |
| 811 670 A | 6/1974 | (BE) . |
| 0 497 748 A | 8/1992 | (EP) . |
| 0 703 139 A1 | 3/1996 | (EP) . |
| 2133290 | 11/1972 | (FR) . |
| 2579951 A | 10/1986 | (FR) . |
| 2597825 A | 10/1987 | (FR) . |

OTHER PUBLICATIONS

*Jane's Intermodal Transportation*, pp. 315, 338 and 341.

* cited by examiner

*Primary Examiner*—Jesus D. Sotelo
(74) *Attorney, Agent, or Firm*—Oliff & Berridge, PLC

(57) ABSTRACT

The invention concerns an autonomous container ship comprising a hull, a propulsion system, loading and unloading systems for loading and unloading containers, and a balancing system. The ship transports containers from larger ports equipped with facilities for loading and unloading containers to smaller ports which may not provide such equipment and may be less than 4 meters deep. The ship includes a propulsion system to propel the ship to cruising speed on the high seas and at lower speeds in estuaries and ports, loading and unloading systems adapted to ports not provided with appropriate equipment, and a balancing system for balancing the ship at sea by providing stability and trim during container handling operations.

19 Claims, 3 Drawing Sheets

AUTONOMOUS CONTAINER SHIP

The invention relates to an autonomous container ship for carrying containers from large ports equipped with loading and unloading means to small ports lacking such equipment.

In particular, the invention relates to a range of small and medium-sized ships that can carry merchandise from one small port to another in containers.

This range is composed of ships able to transport a maximum number of containers equal to two, four, ten, twenty, thirty, fifty, and a hundred.

A principal feature of the ship is its full autonomy, enabling it to load and/or unload containers in a port not equipped with handling means and having a water depth of less than 4 meters.

The transport of goods is indeed one of the mainsprings of our market economy.

The globalization of international trade, the development of "just in time" policies, and the increasing demand for responsiveness are continuously fostering the growth of land transport with development of costly highway infrastructures harmful to the environment.

The range of ships according to the invention arose from this view with the concern of developing complementarity between highway transport and sea/river transport.

The goal is to provide sea links to serve a multitude of irrigation ports that have been exploited little or not at all for goods transport.

The goal is for highway container carriers to load goods from these ports for local distribution to optimize land delivery distances.

One of the objectives of the present invention is to provide trucking companies with a mobile "sea/river superhighway" infrastructure matching the land superhighway system.

A second objective is to increase the responsiveness of sea-land transportation by shipping small quantities at frequent intervals.

A third objective is to provide river/sea service with substantial independence of maneuver, an optimized dock-to-dock path, and unloading/loading systems matching these constraints. This objective implies being able to carry a payload which is large relative to the displacement of the ship.

A fourth objective is to provide transportation under service and mileage conditions comparable to those of highways.

Numerous container ships with a large container-carrying capacity and deep draft exists such as those described in Jane's Intermodal Transportation, pages 315, 338, and 341. One example of these large-capacity container ships is the ALLANCA BRASIL with a capacity of 2200 containers, a speed of 20.4 knots, a length of 200.23 m, and a draft of 12.0 m. One of the smallest of these container ships is the HERA with a capacity of 198 containers, a speed of 12.5 knots, a length of 88 m, and a draft of 4.6 m.

These container ships generally unload in ports equipped with heavy handling equipment. Ports able to receive existing container ships are few in number and cannot deliver goods close to their utilization sites.

To meet the above-defined objectives, the invention relates to an autonomous container ship of the type having a keel, propulsion means, container loading and unloading means, and balancing means, characterized in that it has means for carrying containers from large ports equipped with container loading and unloading means to small ports lacking such equipment and having a water depth less than 4 meters, said means including propulsion means that allow the ship to sail at cruising speed at sea and at estuary and port speeds, loading and unloading means adapted to these ports lacking equipment, and means for balancing the ship at sea serving to stabilize and trim the ship during handling.

This ship is moreover characterized by having propulsion means that ensure maneuverability in ports.

In addition, the ship according to the invention enables a large payload relative to its displacement to be carried. This goal is achieved by equipment providing a common power supply for propulsion and handling, and handling means usable both on board and on land.

The range of ships according to the invention comprises ships able to carry 2, 4, 10, 20, 30, 50, and 100 containers.

The containers are in two sizes:

20-foot containers (6.058×2.438×2.591 meters);

40-foot containers (12.116×2.438×2.591 meters).

The tonnage of the ship range according to the invention is listed in the table below:

| Number of containers | 2 | 4 | 10 | 20 | 30 | 50 | 100 |
|---|---|---|---|---|---|---|---|
| Overall Length (m) | 25 | 35 | 48 | 65 | 74 | 88 | 111 |
| Tonnage (t) | 100 | 200 | 500 | 1000 | 1500 | 2500 | 5000 |

These ships are designed on identical architectural principles. They can hence be built from modules.

These principles can be chosen for the keel, for the propulsion system, for handling the containers, and for balancing the ship.

The keel can be of the single-hulled type.

According to one embodiment, it can be of the beacher type, i.e. the type of ship able to unload cargo onto a gently sloping bank or onto a beach.

According to one preferred embodiment, it can be of the catamaran type or mixed type (single-hulled at the bow and catamaran at the stern) or of the tunnel-hulled type.

Propulsion can be provided by diesel or drive shaft plus propellers.

It can also be provided by an active rudder.

According to one embodiment, propulsion is provided by hydrojet.

According to another embodiment, propulsion is provided by pumpjet Propulsion can also be provided by a device known as "voith"manufactured by the Voith-Schneider Company.

Propulsion can also be provided by a device known as "POD azimutaux"manufactured by the Schottel Company.

The propulsion means can be driven by a diesel engine, by an electric motor, or by a discoid engine.

The containers can be handled by a crane, a portal crane, a lift truck, or a container transporter.

The ship balancing means may be comprised of pumped ballasting system ensuring displacement of water in the ship from ballast to ballast to adjust trim or roll.

The balancing means can be comprised of an inflatable float system; these inflatable floats can be built into the side of the ship to increase float inertia and thus limit rolling and pitching during handling operations.

The balancing means can also be comprised of a solid-weight transfer system. A solid weight moves in the ship to offset shifting container weights during handling operations.

A combination of these various characteristics leads to a design principle for the range of ships.

In addition, it must be possible to build the ship at a cost offering investors an alternative to highway transportation.

With this in mind, the technological solutions leading to economically viable solutions must have the following characteristics.

The ship must enable a large payload relative to its displacement to be carried.

The equipment must be as versatile as possible, implying a common power supply for propulsion and handling, handling means that can be used both on board and on land, propulsion means allowing the ship to sail at cruising speed and at estuary and port speeds, and maneuverability in ports, with the means that balance the ship at sea also serving to balance it during handling operations.

The range of ships according to the invention has autonomy in the following areas:

navigation: slow and rapid propulsion and means of navigation at sea, crew quarters: facilities enabling a crew of 3 to 5 individuals to live for several days on board, handling: handling means enabling the ship to load and unload containers in unequipped ports, balancing: a balancing system ensures transverse stability and trim of the ship when sailing and during container handling operations.

The attached drawings show preferred embodiments of te invention.

FIG. 2 illustrates a ship according to the invention having:

Figure 2:
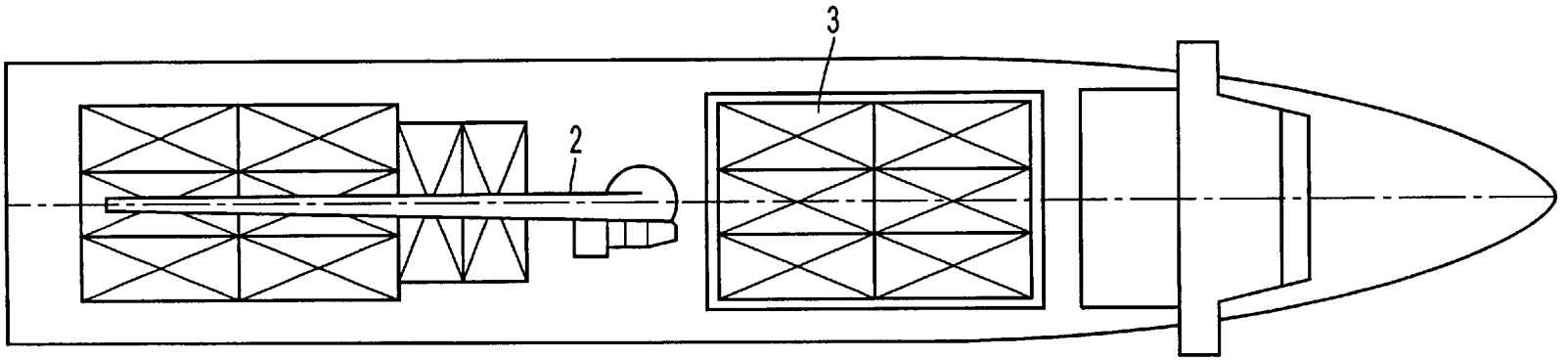
FIG. 2 is a lengthwise section through a ship according to the invention of the single-hulled type equipped with a crane.

a keel 1 of the single-hulled type, a crane 2, containers 3, a propulsion system with propellers 4.

The ship shown has a keel of the single-hulled type defmed above enabling it to sail at between 15 and 20 knots.

The power necessary for operation is provided by a diesel generator.

The propulsion means are comprised of an electric motor, drive shaft, and propellers 4.

The container loading and unloading operations are carried out with a crane 2 mounted at the stem of the ship.

The ship is balanced by ballasting. The roll of the ship is constantly controlled during handling operations by a pump system.

The ship shown has the following characteristics:

overall length: 65 m width: 11 m displacement at full load: 1100 t draft: 4 m number of containers: 20 maximum speed: 17–21 knots

Figure 1:
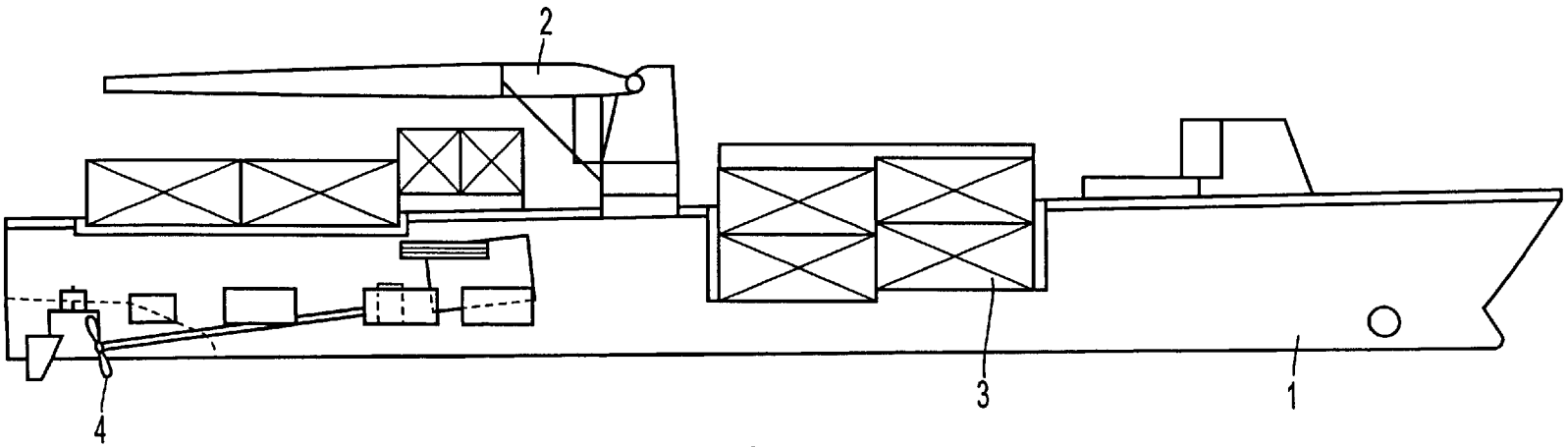
FIG. 1 is a top view of a ship according to the invention of the beacher type with an unloading ramp at the bow.

FIG. 1 is a top view of the ship in FIG. 1 showing crane 2 mounted at the stern.

Figure 3:
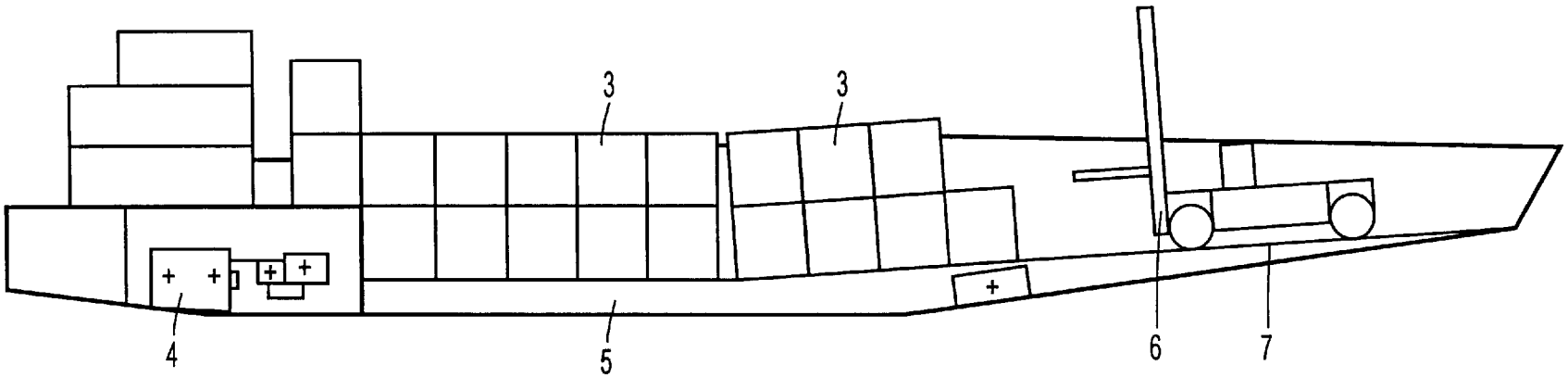
FIG. 3 is a lengthwise section through a ship according to the invention of the beacher type equipped with a ramp at the stern.

FIG. 3 illustrates a ship according to the invention comprising:

a keel flat at bilge 5 for beaching, a lift truck 6, an unloading ramp 7 at the bow containers 3, a propulsion system 4.

The ship shown has a keel flat at bilge 5 allowing a cruising speed of 10 to 12 knots and beaching, i.e. mooring at a gently-sloping bank or at a beach.

The ship can be beached at the bow with stern propulsion.

According to one variant, the ship can be beached at the stern with bow propulsion.

The necessary power is supplied by a diesel generator.

The propulsion means are diesel, drive shaft, and propellers 4.

The handling operations are carried out with the aid of a lift truck 6 and unloading, by a ramp 7 onto a beach or boat ramp.

The ship is balanced by ballasting.

The ship shown has the following characteristics:

overall length: 50 m width: 10 m displacement at full load: 900 t draft: 2.1m number of containers: 20 maximum speed: 10–12 knots

A preferred variant consists of loading and unloading the containers by a stern ramp, in which case the propulsion means are at the bow and the keel is more streamlined, thus improving navigation.

The trim of the ship is balanced by ballasts filled with water by pumps.

Figure 4:
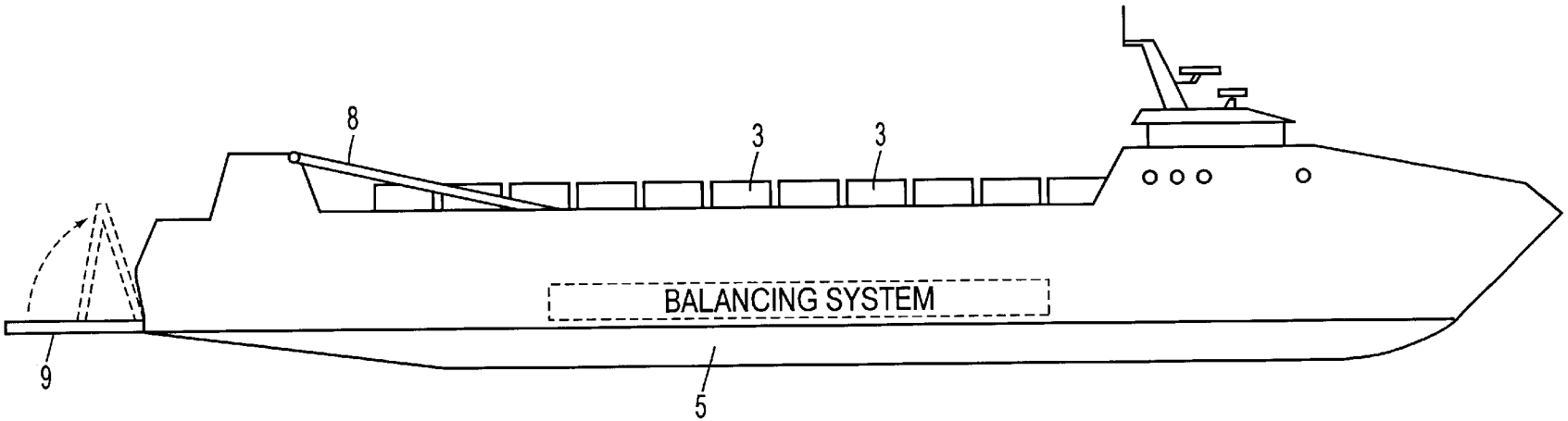
FIG. 4 is a side view of a ship according to the invention of the beacher type equipped with a ramp at the stem.

FIG. 4 shows a ship according to the invention comprising:

a keel flat at bilge 5 for beaching, a self-propelled portal crane 8 a stem loading ramp 9, containers 3 pumpjet propulsion means not shown.

The ship shown has a flat keel 5 for beaching and a cruising speed between

Beaching can take place at the bow with stern propulsion or at the stern with bow propulsion.

The necessary power is supplied by a diesel generator or diesel-electric generator.

Propulsion is provided by pumpjets.

Handling is provided by a self-propelled portal crane 8 and unloading, by a ramp 9 at the stern.

The ship is balanced by a pump and ballast system.

The ship shown has the following characteristics:

overall length: 65 m width: 11 m displacement at fillI load: 1000 t draft: 2.9 m number of containers: 20 maximum speed: 18–20 knots

What is claimed is:

1. A container ship, comprising:

a keel and a propulsion system exhibiting a draft not greater than four meters;

an on-board cargo handling system configured to handle containers inside the ship and outside the ship for loading and unloading the containers; and a balancing system for balancing the ship during sailing and stabilizing and trimming the ship during handling, wherein the cargo handling system comprises at least one part movable above and outside the keel.

2. The container ship of claim 1, wherein the propulsion system enables the ship to maneuver in a port.

3. The container ship of claim 1, wherein the ship contains a common power supply for both the propulsion and cargo handling systems.

4. The container ship of claim 1, wherein the keel is of a single-hulled type.

5. The container ship of claim 1, wherein the keel is of a beacher type.

6. The container ship of claim 1, wherein the keel is of a catamaran type.

7. The container ship of claim 1, wherein the keel is of a mixed type, the mixed type having a single-hulled keel at the ship's bow and a catamaran keel at the ship's stern.

8. The container ship of claim 1, further comprising a diesel generator for providing power.

9. The container ship of claim 1, wherein the propulsion system comprises at least one diesel engine, at least one drive shaft, and at least one propeller.

10. The container ship of claims 1, wherein the propulsion system comprises at least one of a hydrojet, a pumpjet, a voith and multiorientable propellers.

11. The container ship of claim 1, wherein the balancing system comprises a pumped ballast system.

12. The container ship of claim 1, wherein the balancing system comprises an inflatable float system.

13. The container ship of claim 1, wherein the balancing system comprises a solid weight transfer system.

14. The container ship of claim 1, wherein the cargo handling system includes at least one crane supported on the keel.

15. The container ship according to claim 1, wherein the cargo handling system comprises a crane mounted to the ship and capable of moving containers between the ship and the shore.

16. A container ship, comprising:

a keel of a catamaran type and a propulsion system exhibiting a draft not greater than four meters;

an on-board cargo handling system configured to handle containers inside the ship and outside the ship for loading and unloading containers; and a balancing system integral to the ship for balancing the ship during sailing and stabilizing and trimming the ship during handling.

17. A container ship, comprising:

a propulsion system for propelling the ship;

a cargo handling system for loading and unloading cargo containers from the ship, the cargo handling system carried on-board the ship and is extendible outside the ship to load and unload the cargo containers between ship and shore; and a balancing system integral to the ship for balancing the ship at sea and stabilizing and trimming the ship during cargo handling, wherein a draft of the ship, including the propulsion system at least partly extending below the bottom of the ship hull is less than four meters.

18. The container ship according to claim 17, wherein the hull is a catamaran type hull.

19. A container ship, comprising:

a keel and a propulsion system exhibiting a draft not greater than four meters;

an on-board cargo handling system configured to handle containers inside the ship and outside the ship for loading and unloading the containers; and a balancing system for balancing the ship during sailing and stabilizing and trimming the ship during handling, wherein the balancing system comprises an inflatable float system disposed within a hull of the ship.

* * * * *